US005490595A

United States Patent [19]

Sakai et al.

[11] Patent Number: 5,490,595

[45] Date of Patent: Feb. 13, 1996

[54] BUNDLE-OF-ELECTRIC WIRE CONTAINER

[75] Inventors: Koji Sakai; Akio Shirata, both of Kanazawa, Japan

[73] Assignee: Sumitomo Wiring Systems, Ltd., Mie, Japan

[21] Appl. No.: 254,753

[22] Filed: Jun. 6, 1994

[30] Foreign Application Priority Data

Jun. 11, 1993 [JP] Japan ..... 5-031460 U

[51] Int. Cl.[6] ..... B65D 85/06; B65D 85/04

[52] U.S. Cl. ..... 206/408; 206/702; 206/397; 206/503; 206/515; 206/519

[58] Field of Search ..... 206/408, 328, 206/334, 503, 505, 515, 519, 397, 701, 702

[56] References Cited

U.S. PATENT DOCUMENTS

| | | | |
|---|---|---|---|
| 1,850,074 | 3/1932 | Crandall | 206/408 |
| 2,634,020 | 4/1953 | Bartholomew | 206/519 |
| 2,959,279 | 11/1960 | Krafft et al. | 206/408 |
| 3,406,817 | 10/1968 | Lane et al. | 206/408 |
| 3,446,419 | 5/1969 | Mueller | 206/397 |
| 4,511,037 | 4/1985 | Lucous | 206/397 |
| 4,623,063 | 11/1986 | Balkin | 206/408 |
| 5,062,580 | 11/1991 | Meagher . | |
| 5,078,269 | 1/1992 | Dekko et al. | 206/397 |

FOREIGN PATENT DOCUMENTS

| | | |
|---|---|---|
| 2-15886 | 4/1990 | Japan . |
| 2240761 | 8/1991 | United Kingdom . |

*Primary Examiner*—Paul T. Sewell
*Assistant Examiner*—Marie Denise Patterson
*Attorney, Agent, or Firm*—Beveridge, DeGrandi, Weilacher & Young

[57] ABSTRACT

A bundle-of-electric wire container can contain a bundle of electric wire P wound in a loop shape and permit drawing out of the electric wire. Containers can be stacked in a plurality of stages to increase storage efficiency and conveyance efficiency. A bundle-of-electric wire containing space is formed between core pieces and an outer cylinder, and the bundle of electric wire is protected by the outer cylinder. The container is used as one unit for the storage of a bundle of electric wire and to the feeding of the electric wire P through a conveyance. Accordingly, in the manufacturing field of a wiring harness, the bundle of electric wire can be stored and conveyed without losing its shape, for example, and done so efficiently. It is possible to improve the operating efficiency of a manufacturing line by preventing the electric wire from being tangled, for example, at the time of feeding the electric wire as well as to prevent an inferior product from being manufactured.

9 Claims, 8 Drawing Sheets

BUNDLE-OF-ELECTRIC WIRE CONTAINER

BACKGROUND OF THE INVENTION

1. Field of the Invention

The present invention relates to a bundle-of-electric wire container for storing and conveying a bundle of electric wire used for manufacturing, for example, a wiring harness for an automobile.

2. Description of the Prior Art

In a manufacturing line of a wiring harness for an automobile, an electric wire feeding apparatus has been conventionally used for drawing an electric wire from a bundle of electric wire and feeding the same for the succeeding process (the terminal crimping process for cutting the electric wire to predetermined lengths and crimping predetermined terminals in both ends of the cut electric wire).

As an electric wire feeding apparatus for feeding electric wire from a bundle of electric wire, there is provided an electric wire feeding apparatus 20 comprising a circular seat 21, a support 22 fixed to the center of the seat 21, an engaging ring 23 fixed to an upper end surface of the support 22, and a plurality of substantially straight elastic guide bars 24 having their upper ends engaged with the engaging ring 23 and having their lower ends respectively engaged with radial grooves 21*a* provided for the seat 21, as shown in FIG. 8A (see Japanese Utility Model Examined Publication No. 15886/1990). In addition, the above described Publication also discloses an electric wire feeding apparatus 20 in which substantially straight elastic guide bars 24*a* and elastic guide bars 24*b* each having a bent portion are alternately provided, as shown in FIG. 8B. The electric wire feeding apparatuses 20 are so adapted as to insert a center hole of a bundle of electric wire in a loop shape from upper ends of the guide bars 24, 24*a* and 24*b* along the guide bars 24, 24*a* and 24*b* and unwind the bundle of electric wire from the side of the center hole of the bundle of electric wire to draw the electric wire while preventing the bundle of electric wire from losing its shape on outer peripheral surfaces of the guide bars 24, 24*a* and 24*b*.

Furthermore, a variety of electric-wires are used. Bundles of electric wire which are the same in type, diameter and color of electric wire are stored in a shelf or the like in a state where they are stacked in lot of stages where they are bare so in order that they can be easily found and can be efficiently contained. A desired bundle of electric wire is taken out and mounted on the above described electric wire feeding apparatus 20 in use.

However, the bundles of electric wire are stored in a state where they are stacked while bare as described above, and are conveyed bare, to circulate the bundles of electric wire in the manufacturing field. Accordingly, the bundle of electric wire loses its shape and the electric wire located inside of the bundle is made loose during the storage and the conveyance. Particularly when the bundles of electric wire are conveyed in a state where they are stacked in a lot of stages while bare, the bundle of electric wire is liable to lose its shape.

Furthermore, the bundle of electric wire used halfway in a state where it is mounted on the electric wire feeding apparatus 20 and remains by a certain length (the remaining bundle of electric wire), is removed from the electric wire feeding apparatus 20 and stored again in a shelf or the like while being bare. Particularly in this case, however, the bundle of electric wire is liable to lose its shape and the electric wire located inside of the bundle is liable to be made loose.

If electric wires are fed using such a bundle of electric wire which loses its shape, for example, the electric wires drawn from the electric wire feeding apparatus 20 are tangled, for example, resulting in insufficient feeding. The insufficient feeding causes the manufacturing line to be frequently stopped, to decrease the operating efficiency of the line. In addition, the bundle of electric wire loses its shape, resulting in a habit of winding of the electric wire. The habit of winding of the electric wire causes the incidence of insufficient crimping of a terminal to be higher.

SUMMARY OF THE INVENTION

The present invention has been made in view of such a technical background and has for its object to provide a bundle-of-electric wire container suitable for storage and conveyance in the manufacturing field of a wiring harness.

A bundle-of-electric wire container according to the present invention comprises a base having a center hole in its center and having a circular outer edge, a core extending upward from an edge of the center hole of the base, and an outer cylinder extending upward from the outer edge of the base, an annular bundle-of-electric wire containing space being formed between the core and the outer cylinder. Therefore, a bundle of electric wire can be stored and conveyed with its being contained in the bundle-of-electric wire containing space. The outer cylinder can prevent an unnecessary force from being applied to the bundle of electric wire which is being stored and conveyed from the outside. Since an inner peripheral portion of the bundle of electric wire is held by the core, the bundle of electric wire does not lose its shape from the inside.

The outer cylinder is so adapted that the diameter in its lower portion is smaller than that in its upper portion and has a predetermined depth. Accordingly, it is possible to store and convey bundle-of-electric wire containers in a state where they are stacked in a plurality of stages by fitting the outer cylinders to each other.

Furthermore, the upper surface of the outer cylinder is opened. When the electric wire is taken out, therefore, it is possible to easily draw the electric wire upward from the bundle of electric wire contained in the bundle-of-electric wire containing space.

According to a preferred embodiment of the present invention, a fitting depth regulating projection is formed on an outer peripheral surface of the outer cylinder. When the bundle-of-electric wire containers are stacked in a plurality of stages, the regulating projection abuts against an upper edge of the outer cylinder in the lower stage to regulate the depth at which the outer cylinders in the upper and lower stages are fitted to each other. Accordingly, the depth at which the outer cylinders in the upper and lower stages are fitted to each other can be held with high precision, thereby to make it possible to prevent the base of the container in the upper stage from pressing the bundle of electric wire contained in the container in the lower stage uselessly. In addition, the position of the bundle-of-electric wire containers stacked in a plurality of stages is corrected to enter a straight state. Even if the bundle-of-electric wire containers are stacked in many stages, therefore, it is possible to stack them without shaking and stably.

It is preferable that the fitting depth regulating projection is a rib projected into the outer peripheral surface of the outer cylinder. This rib is preferably a rib extending downward from the upper edge of the outer cylinder and having a smaller height than that of the outer cylinder. In addition, it is preferable that a plurality of ribs are formed with approximately equal spacing in the circumferential direction of the outer cylinder.

Furthermore, the core may be a cylindrical member so provided as to extend upward in the center of the base, or may include a plurality of core pieces provided with equal spacing in the circumferential direction of the center hole and extending upward from the edge of the center hole.

If the core comprises the plurality of core pieces, it is preferable that grooves into which upper portions of the core pieces in the lower stage can be inserted are formed in the base in the upper stage when the bundle-of-electric wire containers are stacked in a plurality of stages.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
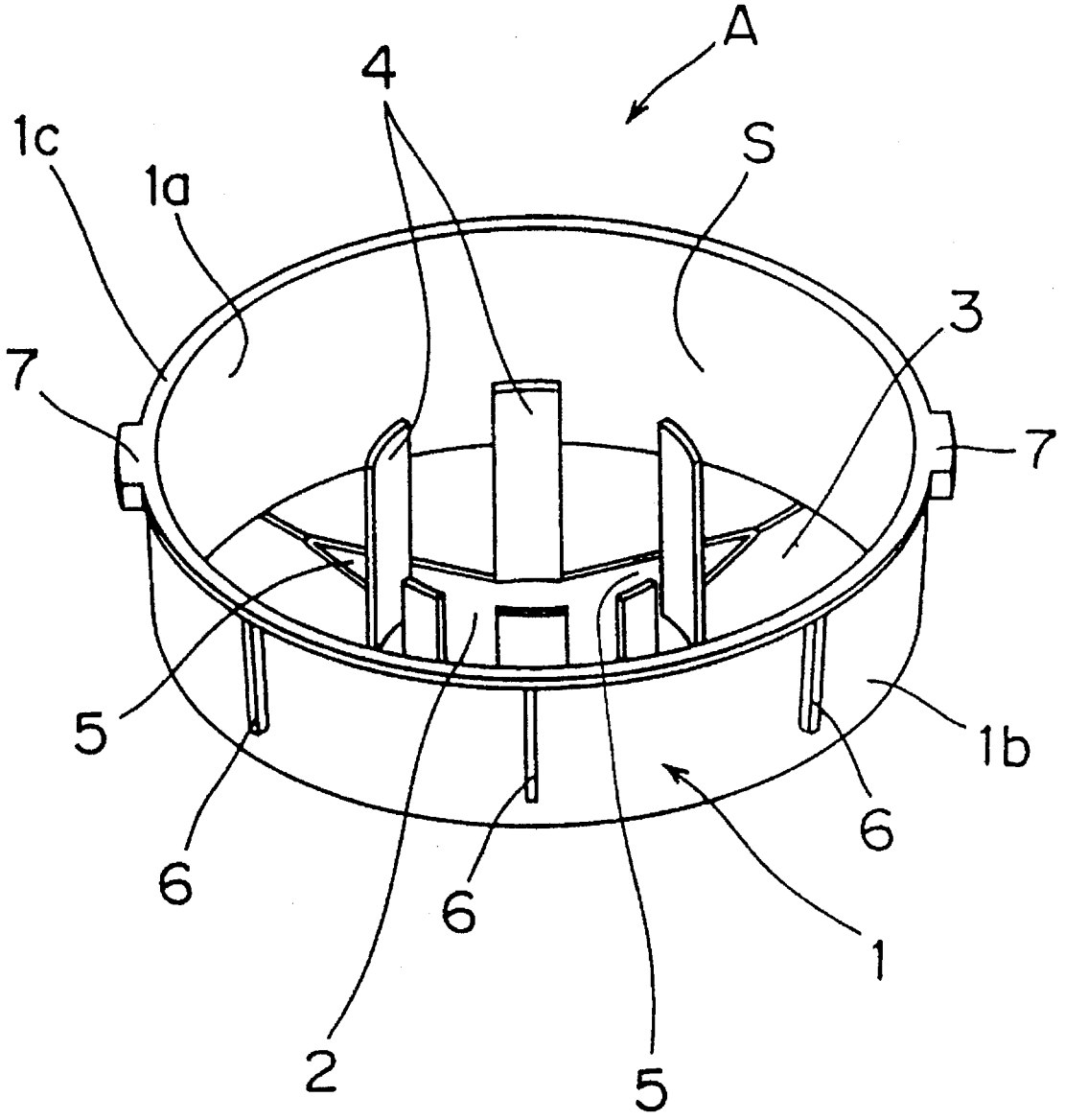
FIG. 1 is a schematic perspective view showing a bundle-of-electric wire container according to one embodiment of the present invention.
Figure 2:
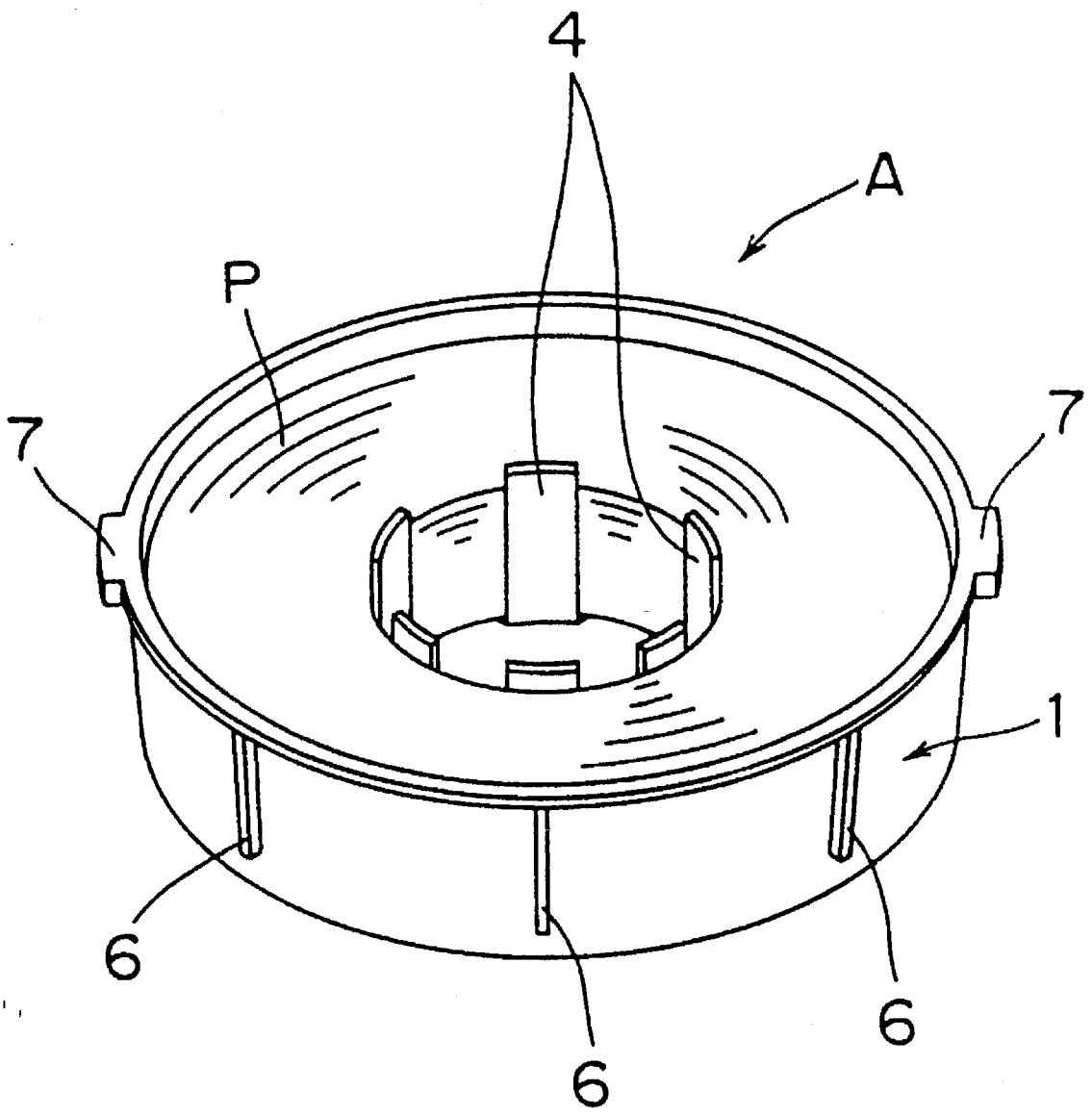
FIG. 2 is a schematic perspective view showing a bundle-of-electric wire container containing a bundle of electric wire.
Figure 3:
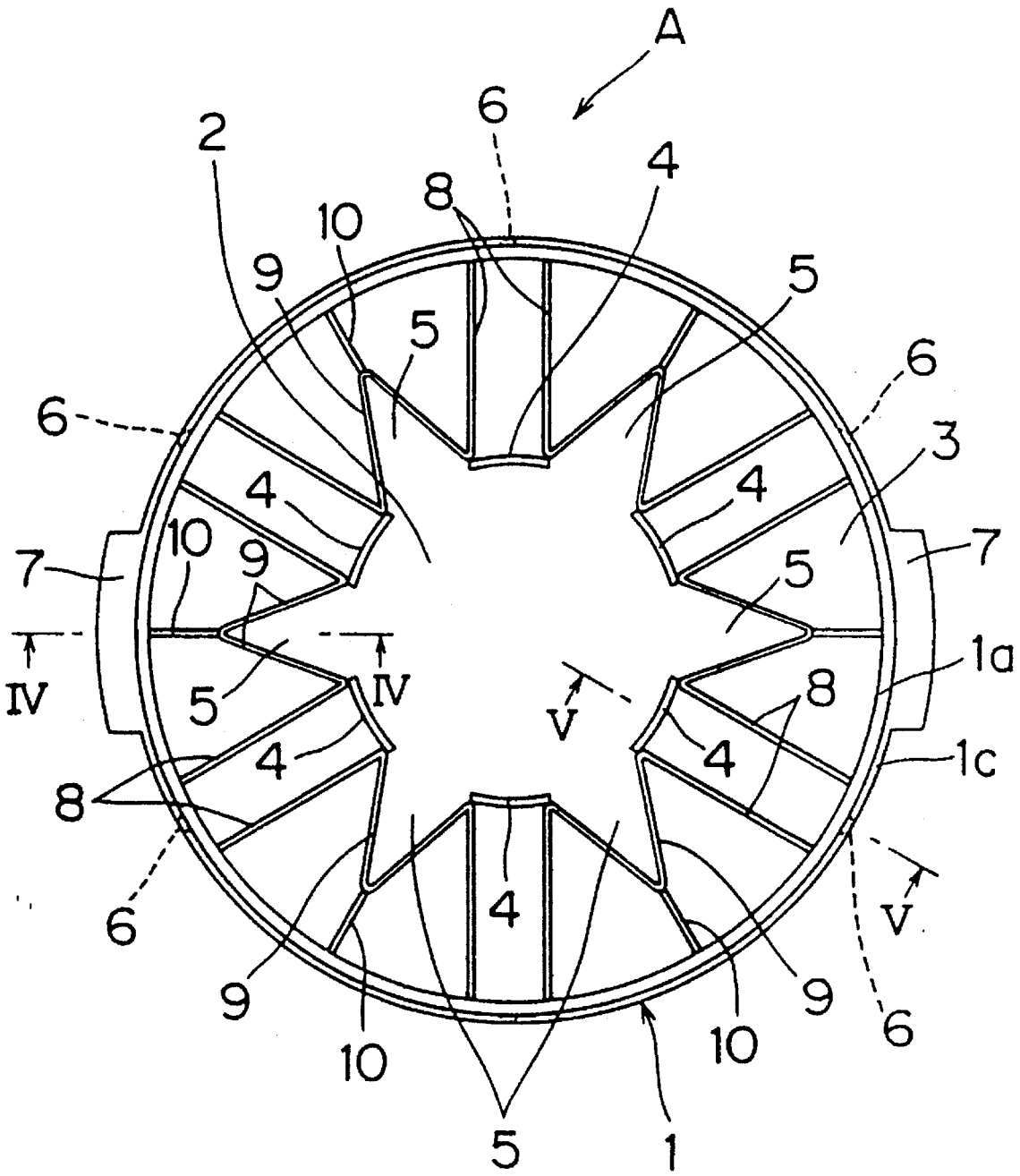
FIG. 3 is a plan view showing a bundle-of-electric wire container.

FIG. 1 is a schematic perspective view showing a state where a bundle-of-electric wire container according to one embodiment of the present invention is empty, FIG. 2 is a schematic perspective view showing the container in a state where a bundle of electric wire is contained, and FIG. 3 is a plan view showing the container. Referring to FIGS. 1 and 2, this bundle-of-electric wire container A (hereinafter referred to as "container A") is constituted by a single tub-shaped product integrally formed of synthetic resin and has an annular bundle-of-electric wire containing space S for containing a bundle of electric wire P wound in a loop shape.

The container A comprises an outer cylinder 1 opening upward, a base 3 having a center hole 2 concentric with the outer cylinder 1 formed therein, a plurality of core pieces 4 extending with equal spacing in the circumferential direction upward from an edge of the center hole 2 and constituting a core, grooves 5 in a substantially triangular shape each provided between the adjacent core pieces 4 and radially extending in a state where they connect with the center hole 2, a plurality of fitting depth regulating ribs 6 serving as fitting depth regulating projections formed with equal spacing in the circumferential direction on an outer peripheral surface 1*b* of the outer cylinder 1, and a pair of handgrips 7 formed in opposed positions of an upper edge of the outer cylinder 1 and extending radially outward.

Figure 4:
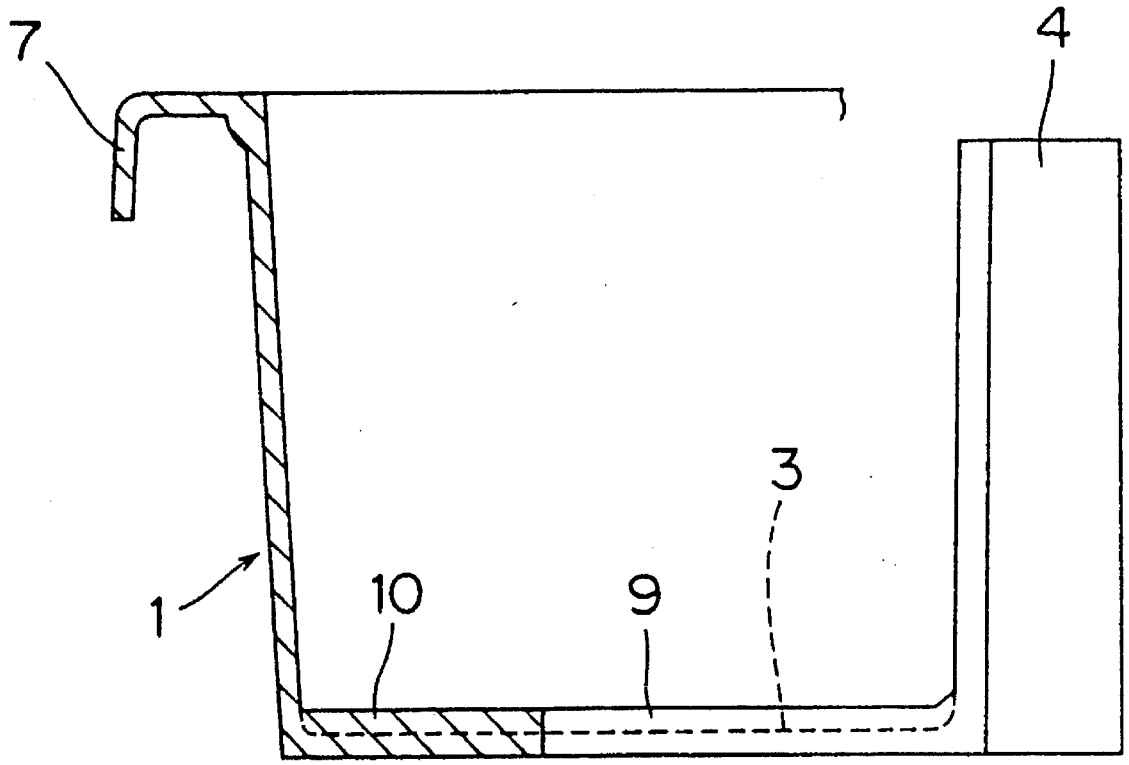
FIG. 4 is a cross sectional view taken along a line VI —VI shown in FIG. 3.

Referring now to FIG. 1 and FIG. 4 which is a cross sectional view taken along a line IV—IV shown in FIG. 3, the outer cylinder 1 has such a depth that in a case where containers A are stacked in a plurality of stages in a state where a bundle of electric wire P is contained, the base 3 of the container A in the upper stage is not strongly pressed against the bundle of electric wire contained in the container A in the lower stage, for example, a depth of approximately 100 mm, and the outer peripheral surface 1*b* of the outer cylinder 1 is inclined at such an angle of inclination (for example, approximately 4° to 5°) that the diameter in its lower portion is smaller than that in its upper portion. The angle of inclination makes it possible to smoothly introduce the base 3 of the container A in the upper stage into the outer cylinder 1 of the container A in the lower stage when the containers A are stacked in a plurality of upper and lower stages.

Referring now to FIG. 3, the base 3 is provided with reinforcing ribs 8 extending radially outward from ends in the circumferential direction of the core pieces 4, reinforcing ribs 9 along outer edges of the grooves 5, and reinforcing ribs 10 extending radially outward from innermost portions of the grooves 5.

The above described annular bundle-of-electric wire containing space S is formed between the core pieces 4 and an inner peripheral surface 1*a* of the outer cylinder 1. As shown in FIG. 2, a bundle of electric wire P wound in a loop shape is contained in the bundle-of-electric wire containing space S. The groove 5 is set to such dimensions that it can receive the core piece 4 in the lower stage when the containers A are stacked in a plurality of stages, as shown in FIG. 6.

Figure 5:
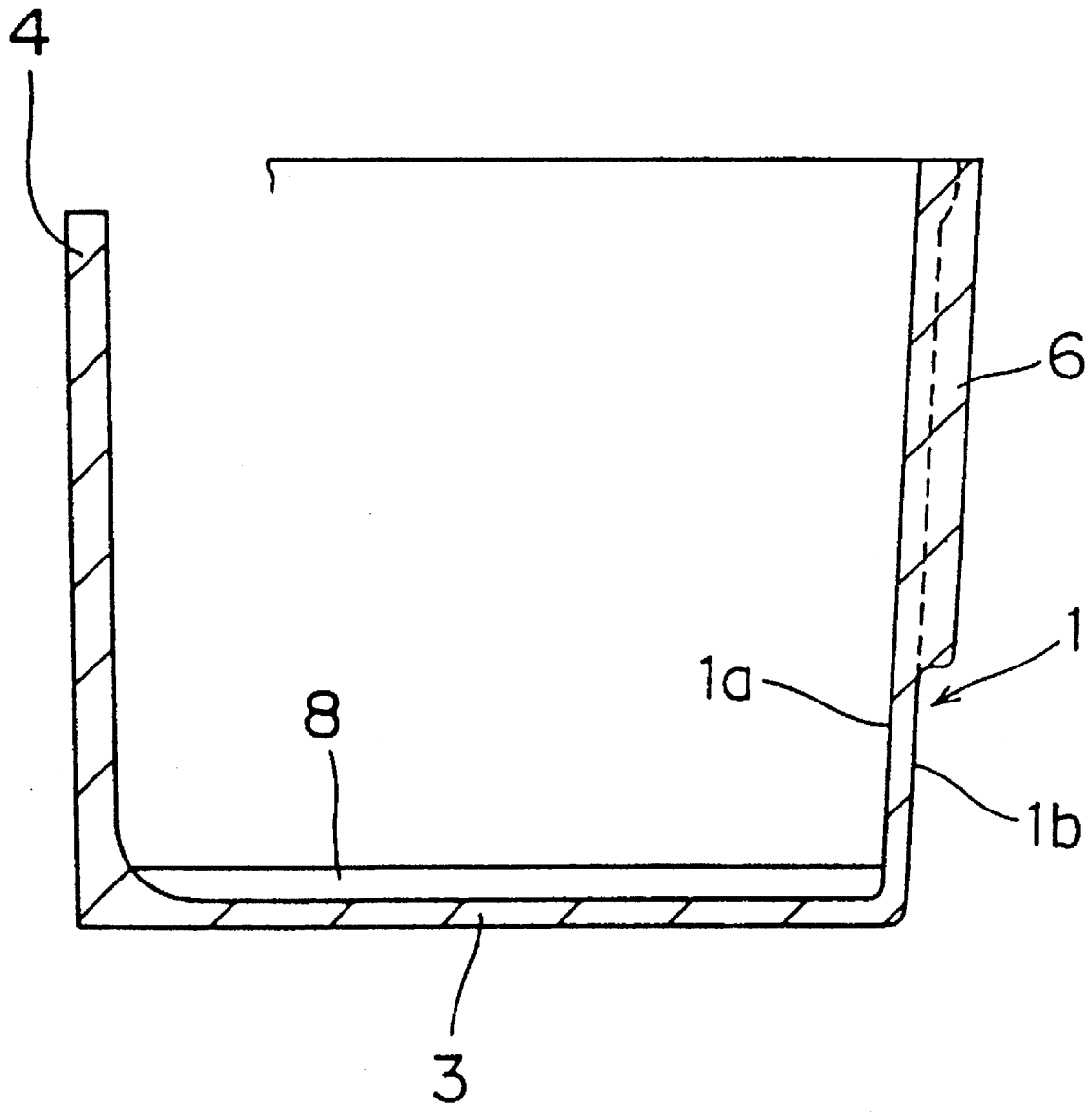
FIG. 5 is a cross sectional view taken along a line V—V shown in FIG. 3.
Figure 6:
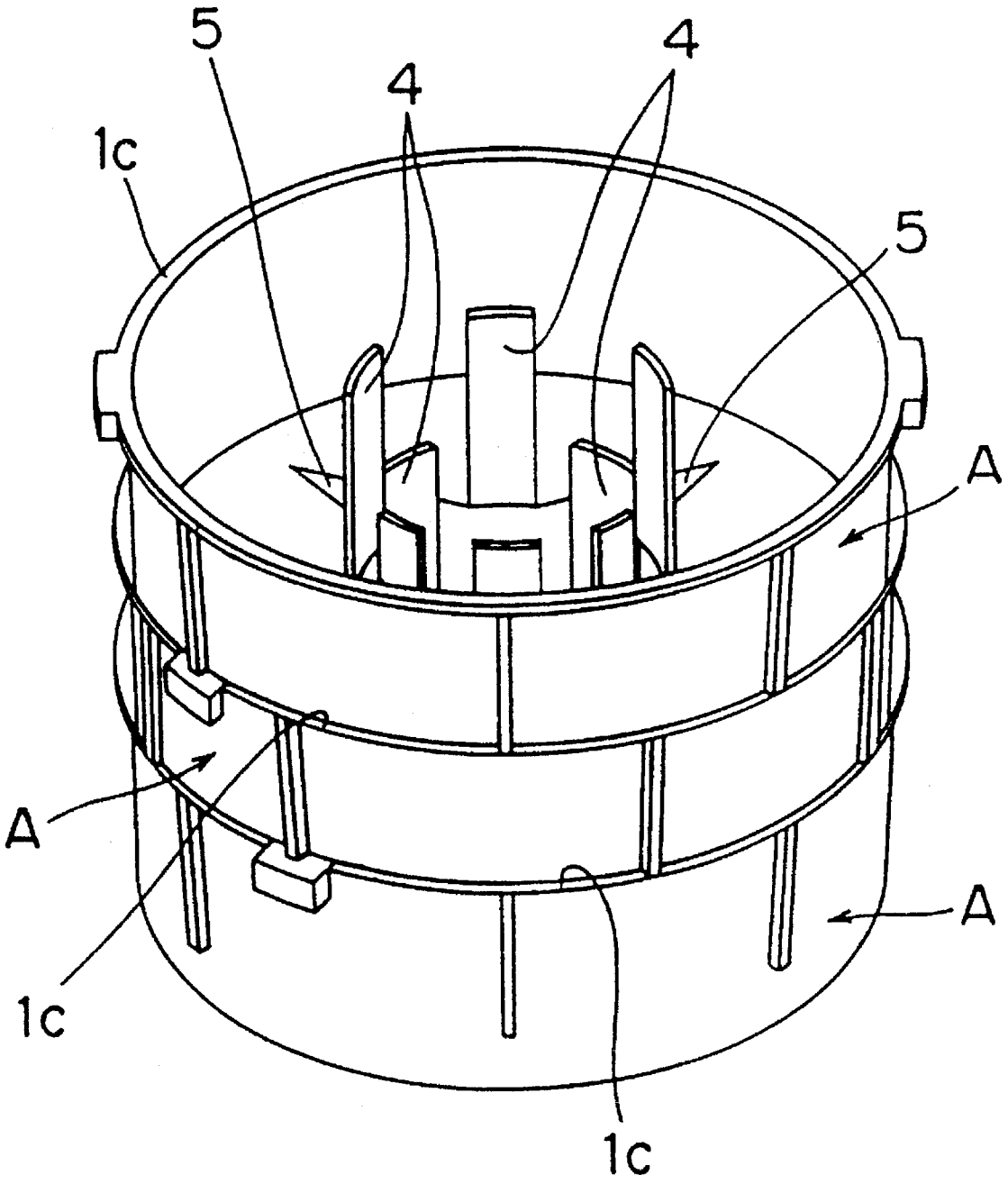
FIG. 6 is a schematic perspective view showing bundle-of-electric wire containers which are stacked in a plurality of stages.

Referring to FIGS. 1 and 6 and FIG. 5 which is a cross sectional view taken along a line V—V shown in FIG. 3, the fitting depth regulating ribs 6 abut against an upper edge 1*c* of the outer cylinder 1 in the lower stage when the containers A are stacked in a plurality of stages, thereby to regulate the depth at which the outer cylinders 1 in the upper and lower stages are fitted to each other. The outer peripheral surface 1*b* of the outer cylinder 1 in the upper stage almost coincides with the inner peripheral surface 1*a* of the outer cylinder 1 in the lower stage in a state where the fitting depth regulating ribs 6 abut against the upper edge 1*c* of the outer cylinder 1 in the lower stage, thereby to make it possible to stack the containers A in the upper and lower stages without shaking and stably. Referring to FIG. 4, the handgrip 7 is in an inverted L shape in cross section, on which human fingers are put in carrying the container A.

Figure 7:
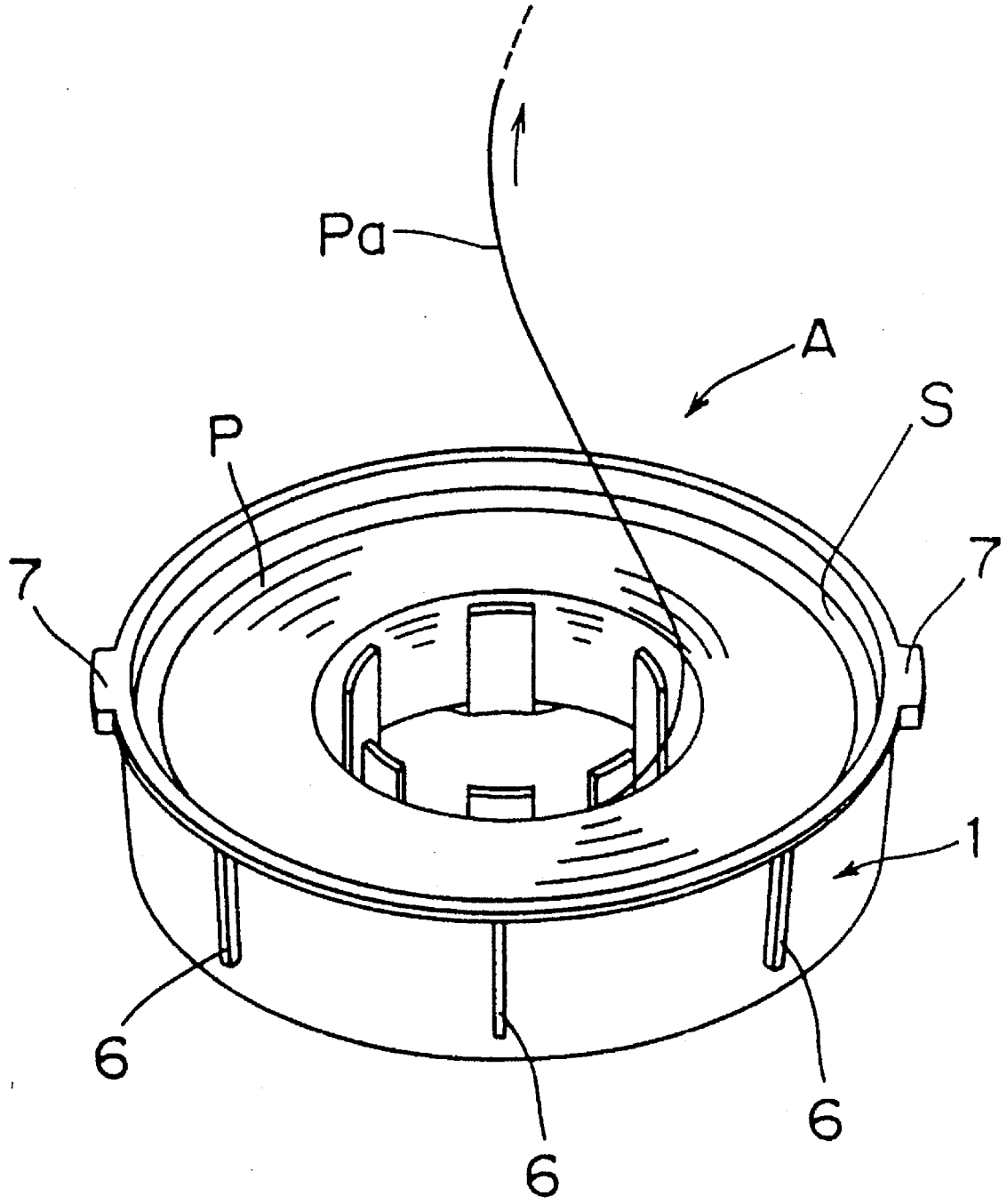
FIG. 7 is a schematic perspective view showing a bundle-of-electric wire container at the time of drawing electric wire.
Figure 8A:
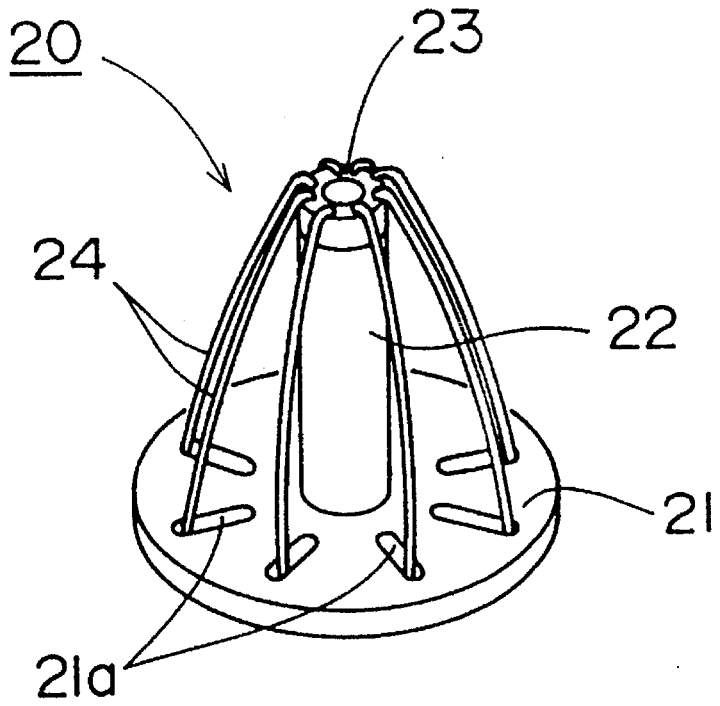
FIG. 8A PRIOR ART
FIGS. 8A and 8B are schematic perspective views showing a conventional electric wire feeding apparatus respectively.
Figure 8B:
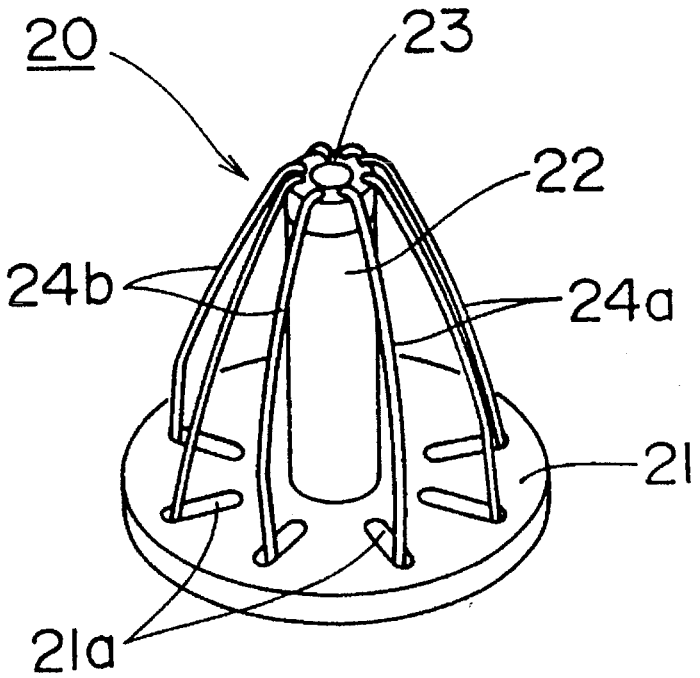
FIG. 8B PRIOR ART

Description is now made of a method of circulating a bundle of electric wire from storage to feeding of electric wire using the container A. When the bundle of electric wire P is stored and conveyed, the bundle of electric wire P is first contained in the annular bundle-of-electric wire containing space S formed between the inner peripheral surface 1*a* of the outer cylinder 1 and the core pieces 4, to store and convey the bundle of electric wire P. If the containers A, each containing the bundle of electric wire P are stacked in a plurality of stages, the circumferential positions of the containers A in the upper and lower stages are shifted, to stack the containers A in a state where the core pieces 4 in the lower stage are projected upward through the grooves 5 in the upper stage, as shown in FIG. 6. In this stacked state, the fitting depth regulating ribs 6 on the outer peripheral surface 1*b* of the outer cylinder 1 in the upper stage abut against the upper edge 1*c* of the outer cylinder 1 in the lower stage, thereby to regulate the depth at which the outer cylinders 1 in the upper and lower stages are fitted to each other to such a depth that the base 3 of the container A in the upper stage does not press the bundle of electric wire P contained in the container A in the lower stage uselessly. In addition, if the present invention is applied to an electric wire feeding apparatus (not shown) to draw electric wire, an electric wire Pa is drawn upward in such a manner that the bundle of electric wire P contained in the bundle-of-electric wire containing space S is unwound in a state where the container A is mounted in a predetermined position, as shown in FIG. 7.

According to the present embodiment, a lot of containers A are prepared for each type of electric wires, and the container A containing the bundle of electric wire P is used as one unit for storage, conveyance and feeding of electric wire (modularized), thereby to make it possible to prevent the bundle of electric wire P from losing its shape, for example, from the storage to the feeding of electric wire through the conveyance. Moreover, the containers A can be stacked in a plurality of stages, thereby to make it possible to store and convey the bundle of electric wires P very efficiently. The containers A can be directly utilized in feeding the electric wires, thereby to make it possible to smoothly replace the containers A. The bundle of electric wire P can be prevented from losing its shape, for example, at the time of the storage and the conveyance as described above, thereby to make it possible to feed the electric wire satisfactorily without being tangled, for example, even in feeding the electric wire. As a result, it is possible to prevent an inferior product from being manufactured as well as to prevent unnecessary stopping of the electric wire feeding apparatus to improve the operating efficiency of the manufacturing line.

Furthermore, the depth at which the outer cylinders 1 in the upper and lower stage are fitted to each other can be regulated with high precision by the fitting depth regulating ribs 6 when the containers A are stacked in a plurality of stages, thereby to make it possible to reliably prevent the base 3 of the container A in the upper stage from pressing the bundle of electric wire P contained in the container A in the lower stage and to make it possible to reliably prevent the bundle of electric wire P from losing its shape. In addition, the position of the container A is forced to enter a straight state by the above described abutment of the fitting depth regulating ribs 6, thereby to make it possible to stack the containers A without shaking and stably, even given many stages, and to stably convey the stacked containers A.

Furthermore, the container A can be easily carried in a stable position with human fingers being put on the pair of handgrips 7, whereby the bundle of electric wire P contained therein does not lose its shape at the time of carrying the container A.

Additionally, the core pieces 4 in the lower stage can be projected upward through the groove 5 in the upper stage by shifting the circumferential positions of the containers A in the upper and lower stages at the time of stacking the containers A, thereby not to regulate the depth at which the containers A in the upper and lower stages are fitted to each other by interference, between the core pieces 4.

The present invention is not limited to the above described embodiment. For example, if a bundle of electric wire is stored in a container A for a long time, an antioxidant (for example, a dehumidifying agent) is contained in a state where a dedicated cover is mounted on the container A to almost seal the inside of the container A, thereby to make it possible to restrain the occurrence of the degradation of the electric wire in the case of the storage.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A single-piece container for containing a bundle of electric wire wound in a loop shape, the container having an inner perimeter and an outer perimeter and comprising:

a base having a circular outer edge having an outer perimeter for defining an outer perimeter of a bundle of electric wire mounted on the base, and a surrounded portion surrounded by the outer edge, the surrounded portion having a center hole formed therein;

a core extending upward from an edge of the center hole of the base for holding an inner peripheral portion of said bundle of electric wire mounted on the base, the core including a plurality of core pieces; and an outer cylinder extending upward from the outer edge of the base, the outer cylinder opening upward and surrounding the core to define an annular bundle-of-electric wire containing space between the outer cylinder and the core, the outer cylinder having a height and having a diameter in its lower portion that is smaller than that in its upper portion so that a plurality of like bundle-of-electric wire containers can be stacked in a plurality of upper and lower stages while each contains a bundle of electric wire therein, the base including means defining grooves which are substantially triangular, the grooves being formed between the core pieces and extending radially outward from connection with the center hole, the grooves receiving the core piece of a lower stage container if the container is stacked in a plurality of stages with such lower stage container.

2. The bundle-of-electric wire container according to claim 1, further comprising fitting depth regulating means on an outer peripheral surface of the outer cylinder, the fitting depth regulating means of the container being adapted to abut against the Upper edge of the outer cylinder of a lower stage container for regulating the depth at which the outer cylinders of the container and such lower stage container are fitted to each other if the container and such lower stage container are stacked.

3. The bundle-of-electric wire container according to claim 2, wherein the fitting depth regulating means comprises a plurality of ribs projecting from the outer peripheral surface of the outer cylinder.

4. The bundle-of-electric wire container according to claim 3, wherein the plurality of ribs extend downward from an upper edge of the outer cylinder, have a height smaller than the height of the outer cylinder, and are formed with approximately equal spacing in the circumferential direction of the outer cylinder.

5. The bundle-of-electric wire container according to claim 2, wherein the plurality of core pieces are provided with equal spacing in the circumferential direction of the center hole, the core pieces extending upward from the edge of the center hole.

6. The bundle-of-electric wire container according to claim 5, wherein the height of each of said core pieces is made approximately equal to the height of the outer cylinder.

7. The bundle-of-electric wire container according to claim 1, wherein ribs for reinforcing the base are formed on the base.

8. The bundle-of-electric wire container according to claim 1, wherein a pair of handgrips are disposed, in opposed positions spaced apart from each other by approximately 180°, on the upper edge of the outer peripheral surface of the outer cylinder, the handgrips projecting outwardly from the outer cylinder.

9. The bundle-of-electric wire container according to claim 1, wherein said bundle-of-electric wire container is integrally formed of synthetic resin.

* * * * *